US011686518B2

(12) United States Patent
Takegami et al.

(10) Patent No.: US 11,686,518 B2
(45) Date of Patent: Jun. 27, 2023

(54) REFRIGERATION APPARATUS THAT OPERATES A UTILIZATION UNIT BASED ON DRIVABILITY OF A COMPRESSOR IN A HEAT SOURCE UNIT

(71) Applicant: DAIKIN INDUSTRIES, LTD., Osaka (JP)

(72) Inventors: Masaaki Takegami, Osaka (JP); Shuichi Taguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/707,322

(22) Filed: Mar. 29, 2022

(65) Prior Publication Data

US 2022/0221209 A1 Jul. 14, 2022

Related U.S. Application Data

(63) Continuation of application No. PCT/JP2020/025229, filed on Jun. 26, 2020.

(30) Foreign Application Priority Data

Sep. 30, 2019 (JP) ..... 2019-179458

(51) Int. Cl.

| | |
|---|---|
| ***F25B 49/02*** | (2006.01) |
| ***F24F 11/32*** | (2018.01) |
| ***F24F 11/50*** | (2018.01) |
| ***F25B 9/00*** | (2006.01) |

(52) U.S. Cl.

CPC ..... *F25B 49/022* (2013.01); *F24F 11/32* (2018.01); *F24F 11/50* (2018.01); *F25B 9/008* (2013.01); *F25B 2500/07* (2013.01); *F25B 2600/0272* (2013.01); *F25B 2600/2513* (2013.01)

(58) Field of Classification Search

CPC .... F25B 9/008; F25B 49/022; F25B 2500/26; F25B 2600/0251; F25B 2600/0272; F25B 2500/07; F24F 11/32; F24F 11/54; F24F 1/08; F24F 1/20; F24F 11/37; F24F 11/50

See application file for complete search history.

(56) References Cited

U.S. PATENT DOCUMENTS 4,142,375 A * 3/1979 Abe ..... G05D 23/19 361/22

FOREIGN PATENT DOCUMENTS

| | | |
|---|---|---|
| EP | 2 015 005 A2 | 1/2009 |
| EP | 2 015 005 A3 | 9/2011 |
| JP | 3-1061 A | 1/1991 |

(Continued)

OTHER PUBLICATIONS

International Search Report (PCT/ISA/210) issued in PCT/JP2020/025229, dated Sep. 8, 2020.

(Continued)

*Primary Examiner* — Jerry-Daryl Fletcher
*Assistant Examiner* — Daniel C Comings
(74) *Attorney, Agent, or Firm* — Birch, Stewart, Kolasch & Birch, LLP

(57) ABSTRACT

The heat source controller transmits the drive permission signal (SE) to the utilization controller when the compression element is drivable. The utilization controller opens a utilization expansion valve when heat exchange in a utilization heat exchanger is required, on condition that the utilization controller receive the drive permission signal (SE).

8 Claims, 8 Drawing Sheets

(56) References Cited

FOREIGN PATENT DOCUMENTS

| | | | | | |
|---|---|---|---|---|---|
| JP | 4-110556 | A | | 4/1992 | |
| JP | H04110556 | | * | 4/1992 | ..... F25B 49/02 |
| JP | 2012-47395 | A | | 3/2012 | |
| JP | 2012-202620 | A | | 10/2012 | |
| JP | 2013-174402 | A | | 9/2013 | |
| JP | 2015-49021 | A | | 3/2015 | |

OTHER PUBLICATIONS

English translation of Interational Preliminary Report on Patentability and Written Opinion of the International Searching Authority for International Application No. PCTJP2020/025229, dated Apr. 14, 2022.

Extended European Search Report dated Oct. 14, 2022 in counterpart European Application No. 20871304.0.

* cited by examiner

REFRIGERATION APPARATUS THAT OPERATES A UTILIZATION UNIT BASED ON DRIVABILITY OF A COMPRESSOR IN A HEAT SOURCE UNIT

CROSS REFERENCE TO RELATED APPLICATIONS

This application is a Continuation of PCI International Application No. PCT/JP2020/025229, filed on Jun. 26, 2020, which claims priority under 35 U.S.C. 119(*a*) to Patent Application No. 2019-179458, filed in Japan on Sep. 30, 2019, all of which are hereby expressly incorporated by reference into the present application.

TECHNICAL FIELD

The present disclosure relates to a refrigeration apparatus and a heat source unit.

BACKGROUND ART

Patent Document 1 discloses a refrigeration apparatus. The refrigeration apparatus includes a refrigerator and a showcase. The refrigerator is provided with a compressor. The showcase is p vided with a motor-operated valve, a main expansion valve, and an evaporator. The refrigerator and the showcase are connected by a high-pressure pipe and a low-pressure pipe to form a refrigerant circuit. Each of the refrigerator and the showcase is provided with a terminal controller. The terminal controller provided for the refrigerator controls the compressor. The terminal controller provided for the showcase controls the motor-operated valve and the main expansion valve.

CITATION LIST

Patent Document

Patent Document 1: Japanese Unexamined Patent Publication No. 2015-49021

SUMMARY

A first aspect of the present disclosure is directed to a refrigeration apparatus using carbon dioxide as a refrigerant. The refrigeration apparatus includes: a heat source unit (10) having a compression element (20), a heat source heat exchanger (40), and a heat source controller (14); and a utilization unit (15) having a utilization heat exchanger (70), a utilization expansion valve (71), and a utilization controller (18), wherein the heat source unit (10) and the utilization unit (15) are connected, the heat source controller (14) transmits a drive permission signal (SE) to the utilization controller (18) when the compression element (20) is drivable, and the utilization controller (18) opens the utilization expansion valve (71) when heat exchange in the utilization heat exchanger (70) is required, on condition that the utilization controller (18) receive the drive permission signal (SE).

BRIEF DESCRIPTION OF THE DRAWINGS

FIG. 1 is a flowchart illustrating operation of the utilization controller while a utilization expansion valve is fully closed.

DESCRIPTION OF EMBODIMENTS

Figure 1:
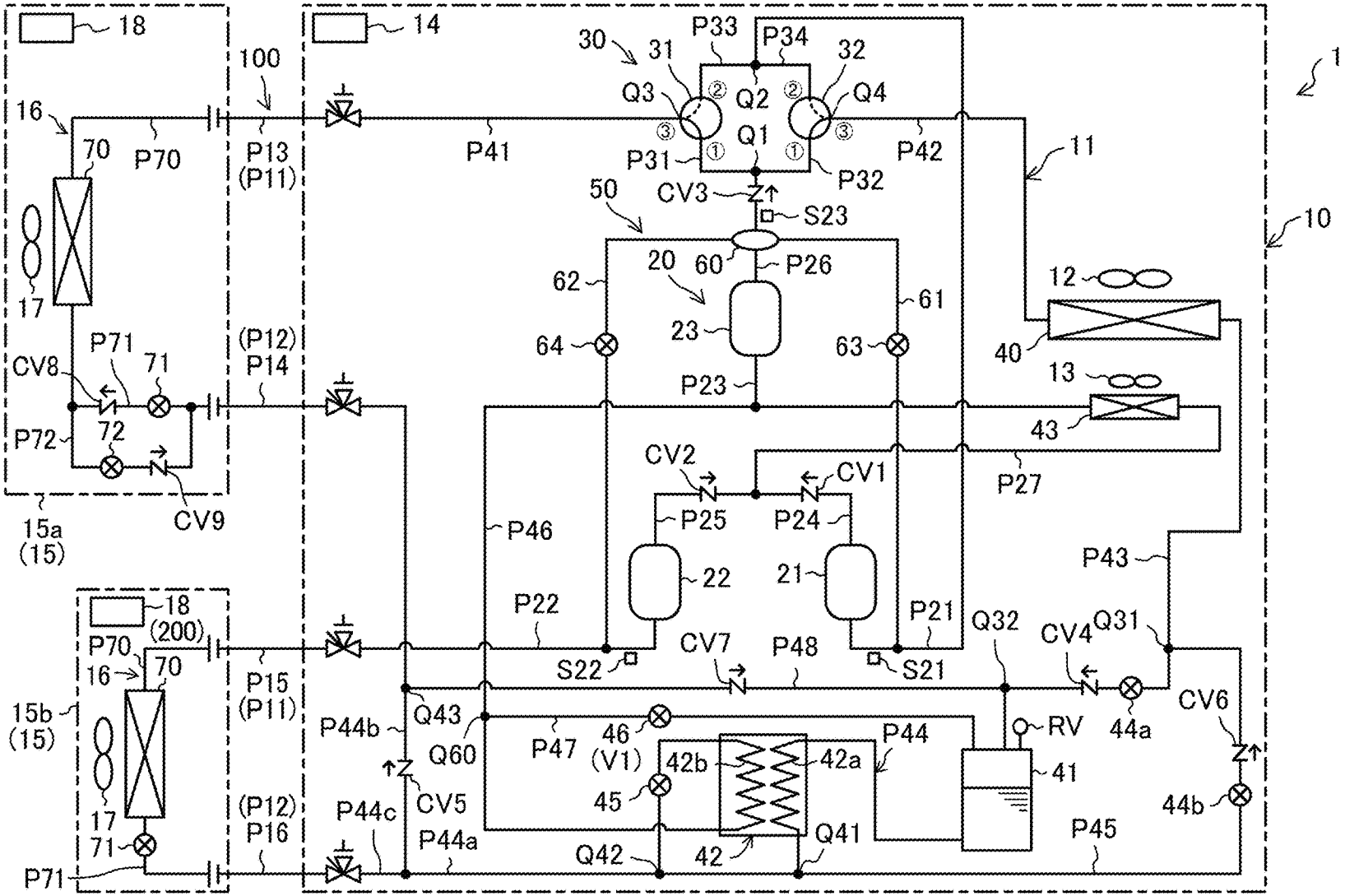
FIG. 1 is a piping system diagram illustrating a configuration of a refrigeration apparatus according to an embodiment.

Embodiments will be described below in detail with reference to the drawings. Note that like reference characters denote the same or equivalent components in the drawings, and the description thereof will not be repeated.

(Refrigeration Apparatus)

FIG. 1 illustrates a configuration of a refrigeration apparatus (1) according to an embodiment. The refrigeration apparatus (1) includes a heat source unit (10) and one or more utilization units (15). The heat source unit (10) and the one or more utilization units (15) are connected by a gas connection pipe (P11) and a liquid connection pipe (P12) to form a refrigerant circuit (100).

In this example, the refrigeration apparatus (1) cools the interior of a refrigeration facility such as a refrigerator, a freezer, and a showcase (will be hereinafter referred to as "cold storage"), and conditions the air in a room. Specifically, the refrigeration apparatus (1) includes two utilization units (15). One of the two utilization units (15) constitutes an indoor unit (15*a*) provided indoors, and the other constitutes a cold storage unit (15*b*) provided for the cold storage. In this example, the heat source unit (10) is placed outdoors. The refrigeration apparatus (1) is provided with a first gas connection pipe (P13) and a first liquid connection pipe (P14) corresponding to the indoor unit (15*a*), and a second gas connection pipe (P15) and a second liquid connection pipe (P16) corresponding to the cold storage unit (15*b*). The heat source unit (10) and the indoor unit (15*a*) are connected by the first gas connection pipe (P13) and the first liquid connection pipe (P14), and the heat source unit (10) and the cold storage unit (15*b*) are connected by the second gas connection pipe (P15) and the second liquid connection pipe (P16), thereby forming the refrigerant circuit (100).

A refrigerant circulates in the refrigerant circuit (100) to perform a refrigeration cycle. In this example, the refrigerant filling the refrigerant circuit (100) is carbon dioxide. The refrigerant circuit (100) is configured to perform a refrigeration cycle in which the pressure of the refrigerant is equal to or greater than a critical pressure.

[Heat Source Unit and Utilization Unit]

The heat source unit (10) includes a heat source circuit (11), a heat source fan (12), a cooling fan (13), and a heat source controller (14). The utilization unit (15) includes a utilization circuit (16), a utilization fan (17), and a utilization controller (18). The gas connection pipe (P11) connects a gas end of the heat source circuit (11) and a gas end of the utilization circuit (16), and the liquid connection pipe (P12) connects a liquid end of the heat source circuit (11) and a liquid end of the utilization circuit (16). Thus, the refrigerant circuit (100) is formed.

In this example, the first gas connection pipe (P13) connects the gas end of the heat source circuit (11) and the gas end of the utilization circuit (16) of the indoor unit (15*a*), and the first liquid connection pipe (P14) connects the liquid end of the heat source circuit (11) and the liquid end of the utilization circuit (16) of the indoor unit (15*a*). The second gas connection pipe (P15) connects the gas end of the heat source circuit (11) and the gas end of the utilization circuit (16) of the cold storage unit (15*b*), and the second liquid connection pipe (P16) connects the liquid end of the heat source circuit (11) and the liquid end of the utilization circuit (16) of the cold storage unit (15*b*).

[Heat Source Circuit]

The heat source circuit (11) includes a compression element (20), a switching unit (30), a heat source heat exchanger (40), a receiver (41), a cooling heat exchanger (42), an intercooler (43), a first heat source expansion valve (44*a*), a second heat source expansion valve (44*b*), cooling expansion valve (45), a venting valve (46), and a pressure release valve (RV). The heat source circuit (11) is provided with first to eighth heat source passages (P41 to P48). For example, the first to eighth heat source passages (P41 to P48) are formed by refrigerant pipes.

<Compression Element>

The compression element (20) sucks the refrigerant, compresses the sucked refrigerant, and discharges the compressed refrigerant. In this example, the compression element (20) includes a plurality of compressors. Specifically, the compression element (20) includes a first compressor (21), a second compressor (22), and a third compressor (23). In this example, the compression element (20) is a two-stage compression element. The first compressor (21) and the second compressor (22) are low-stage compressors, and the third compressor (23) is a high-stage compressor. The first compressor (21) corresponds to the indoor unit (15*a*), and the second compressor (22) corresponds to the cold storage unit (15*b*).

The first compressor (21) has a suction port and a discharge port. The first compressor (21) sucks the refrigerant through the suction port to compress the refrigerant, and discharges the compressed refrigerant through the discharge port. In this example, the first compressor (21) is a rotary compressor including an electric motor and a compression mechanism rotationally driven by the electric motor. For example, the first compressor (21) is a scroll compressor. The first compressor (21) is a variable capacity compressor whose number of rotations (operation frequency) is adjustable.

The second compressor (22) and the third compressor (23) are configured in the same manner as the first compressor (21). In this example, the suction port of each of the first compressor (21), the second compressor (22), and the third compressor (23) constitutes an inlet of the compression element (20), and the discharge port of the third compressor (23) constitutes an outlet of the compression element (20).

Further, in this example, the compression element (20) has first to third suction passages (P21 to P23), first to third discharge passages (P24 to P26), and an intermediate passage (P27). For example, these passages (P21 to P27) are formed by refrigerant pipes. Each of the first to third suction passages (P21 to P23) has one end connected to the suction port of the corresponding one of the first to third compressors (21 to 23). The other end of the first suction passage (P21) is connected to a second port (Q2) of the switching unit (30). The other end of the second suction passage (P22) is connected to one end of the second gas connection pipe (P15). One end of each of the first to third discharge passages (P24 to P26) is connected to the discharge port of the corresponding one of the first to third compressors (21 to 23). The other end of the third discharge passage (P26) is connected to a first port (Q1) of the switching unit (30). One end of the intermediate passage (P27) is connected to the other end of the first discharge passage (P24) and the other end of the second discharge passage (P25), and the other end of the intermediate passage (P27) is connected to the other end of the third suction passage (P23).

<Switching Unit>

The switching unit (30) has a first port (Q1), a second port (Q2), a third port (Q3), and a fourth port (Q4), and switches the state of communication among the first to fourth ports (Q1 to Q4). The first port (Q1) is connected to the discharge port of the third compressor (23), which is the outlet of the compression element (20), by the third discharge passage (P26). The second port (Q2) is connected to the suction port of the first compressor (21) by the first suction passage (P21), The third port (Q3) is connected to one end of a first heat source passage (P41), and the other end of the first heat source passage (P41) is connected to one end of the first gas connection pipe (P13). The fourth port (Q4) is connected to one end of a second heat source passage (P42), and the other end of the second heat source passage (P42) is connected to the gas end of the heat source heat exchanger (40).

In this example, the switching unit (30) includes a first three-way valve (31) and a second three-way valve (32). The switching unit (30) also includes first to fourth switching passages (P31 to P34). The first to fourth switching passages (P31 to P34) are formed by, for example, refrigerant pipes. The first three-way valve (31) has first to third ports, and is switched between a first communication state (a state indicated by a solid curve in FIG. 1) in which the first and third ports communicate with each other, and a second communication state (a state indicated by a broken curve in FIG. 1) in which the second and third ports communicate with each other. The second three-way valve (32) is configured in the same manner as the first three-way valve (31).

The first switching passage (P31) connects the first port of the first three-way valve (31) and the other end of the third discharge passage (P26). The second switching passage (P32) connects the first port of the second three-way valve (32) and the other end of the third discharge passage (P26). The third switching passage (P33) connects the second port of the first three-way valve (31) and the other end of the first suction passage (P21). The fourth switching passage (P34) connects the second port of the second three-way valve (32) and the other end of the first suction passage (P21). The third port of the first three-way valve (31) is connected to one end of the first gas connection pipe (P13) by the first heat source passage (P41). The third port of the second three-way valve (32) is connected to the gas end of the heat source heat exchanger (40) by the second heat source passage (P42).

In this example, a junction of the first switching passage (P31), the second switching passage (P32), and the third discharge passage (P26) constitutes the first port (Q1), and a junction of the third switching passage (P33), the fourth switching passage (P34), and the first suction passage (P21) constitutes the second port (Q2). The third port of the first three-way valve (31) constitutes the third port (Q3), and the third port of the second three-way valve (32) constitutes the fourth port (Q4).

<Heat Source Fan and Heat Source Heat Exchanger>

The heat source fan (12) is arranged near the heat source heat exchanger (40) and conveys the air (outdoor air in this example) to the heat source heat exchanger (40). The heat source heat exchanger (40) exchanges heat between the refrigerant flowing through the heat source heat exchanger (40) and the air conveyed by the heat source fan (12) to the heat source heat exchanger (40). For example, the heat source heat exchanger (40) is a fin-and-tube heat exchanger.

In this example, the gas end of the heat source heat exchanger (40) is connected to the fourth port (Q4) of the switching unit (30) 1*w* the second heat source passage (P42). The liquid end of the heat source heat exchanger (40) is connected to one end of the third heat source passage (P43), and the other end of the third heat source passage (P43) is connected to the inlet of the receiver (41).

<Receiver>

The receiver (41) stores the refrigerant and separates the refrigerant into a gas refrigerant and a liquid refrigerant. For example, the receiver (41) is constituted of a pressure vessel. The receiver (41) is configured to be heatproof. For example, a heat insulating layer made of a heat insulating material is provided on a peripheral wall of the receiver (41).

In this example, the inlet of the receiver (41) is connected to the liquid end of the heat source heat exchanger (40) by the third heat source passage (P43). A liquid outlet of the receiver (41) is connected to one end of the liquid connection pipe (P12) by the fourth heat source passage (P44). Specifically, the fourth heat source passage (P44) includes a main passage (P44*a*), a first branch passage (P44*b*), and a second branch passage (P44*c*). One end of the main passage (P44*a*) is connected to the liquid outlet of the receiver (41). One end of the first branch passage (P44*b*) is connected to the other end of the main passage (P44*a*), and the other end of the first branch passage (P44*b*) is connected to one end of the first liquid connection pipe (P14). One end of the second branch passage (P44*c*) is connected to the other end of the main passage (P44*a*), and the other end of the second branch passage (P44*c*) is connected to one end of the second liquid connection pipe (P16).

In this example, one end of the fifth heat source passage (P45) is connected to a first intermediate portion (Q41) of the fourth heat source passage (P44), and the other end of the fifth heat source passage (P45) is connected to a first intermediate portion (Q31) of the third heat source passage (P43). One end of the sixth heat source passage (P46) is connected to a second intermediate portion (Q42) of the fourth heat source passage (P44), and the other end of the sixth heat source passage (P46) is connected to the other end of the third suction passage (P23). One end of the seventh heat source passage (P47) is connected to a gas outlet of the receiver (41), and the other end of the seventh heat source passage (P47) is connected to an intermediate portion (Q60) of the sixth heat source passage (P46). One end of the eighth heat source passage (P48) is connected to a second intermediate portion (Q32) of the third heat source passage (P43), and the other end of the eighth heat source passage (P48) is connected to a third intermediate portion (Q43) of the fourth heat source passage (P44).

The second intermediate portion (Q32) of the third heat source passage (P43) is located in the third heat source passage (P43) between the first intermediate portion (Q31) and the receiver (41). In the fourth heat source passage (P44), the first intermediate portion (Q41), the second intermediate portion (Q42), and the third intermediate portion (Q43) are arranged in this order from the liquid outlet of the receiver (41) toward one end of the liquid connection pipe (P12). Specifically, the first intermediate portion (Q41) of the fourth heat source passage (P44) is located in the main passage (P44*a*) of the fourth heat source passage (P44). The second intermediate portion (Q42) of the fourth heat source passage (P44) is located in the main passage (P44*a*) of the fourth heat source passage (P44) between the first intermediate portion (Q41) and the other end of the main passage (P44*a*), i.e., a junction of the main passage (P44*a*), the first branch passage (P44*b*), and the second branch passage (P44*c*). The third intermediate portion (Q43) of the fourth heat source passage (P44) is located in the first branch passage (P44*b*) of the fourth heat source passage (P44).

<Heat Source Passage>

In this example, the first heat source passage (P41) is a passage provided for communication between the outlet of the compression element (20) and the gas end of the utilization circuit (16) of the indoor unit (15*a*) The second heat source passage (P42) is a passage provided for communication between the outlet of the compression element (20) and the gas end of the heat source heat exchanger (40). The third heat source passage (P43) is a passage provided for communication between the liquid end of the heat source heat exchanger (40) and the inlet of the receiver (41). The fourth heat source passage (P44) is a passage provided for communication between the liquid outlet of the receiver (41) and the liquid ends of the utilization circuits (16) of the indoor unit (15*a*) and the cold storage unit (15*b*). The fifth heat source passage (P45) is a passage provided for communication between the liquid outlet of the receiver (41) and the liquid end of the heat source heat exchanger (40). The sixth heat source passage (P46) is a passage (injection passage) provided to supply part of the refrigerant flowing through the fourth heat source passage (P44) to the inlet of the compression element (20) (the suction port of the third compressor (23) in this example). The seventh heat source passage (P47) is a passage (venting passage) provided to discharge the gas refrigerant collected in the receiver (41) from the receiver (41). The eighth heat source passage (P48) is a passage provided for communication between the liquid end of the utilization circuit (16) of the indoor unit (15*a*) and the inlet of the receiver (41).

<Cooling Heat Exchanger>

The cooling heat exchanger (42) is connected to the fourth heat source passage (P44) and the sixth heat source passage (P46), and exchanges heat between the refrigerant flowing through the fourth heat source passage (P44) and the refrigerant flowing through the sixth heat source passage (P46). In this example, the cooling heat exchanger (42) includes a first refrigerant passage (42*a*) incorporated in the fourth heat source passage (P44) and a second refrigerant passage (42*b*) incorporated in the sixth heat source passage (P46), and exchanges heat between the refrigerant flowing through the first refrigerant passage (42*a*) and the refrigerant flowing through the second refrigerant passage (42*b*). Specifically, the first refrigerant passage (42*a*) is arranged in the fourth heat source passage (P44) between the receiver (41) and the first intermediate portion (Q41). The second refrigerant passage (42*b*) is arranged in the sixth heat source passage (P46) between one end of the sixth heat source passage (P46) (the second intermediate portion (Q42) of the fourth heat source passage (P44)) and the intermediate portion (Q60). For example, the cooling heat exchanger (42) is a plate heat exchanger.

<Cooling Fan and Intercooler>

The cooling fan (13) is arranged near the intercooler (43) and conveys the air (outdoor air in this example) to the intercooler (43). The intercooler (43) is provided in the intermediate passage (P27), and exchanges heat between the refrigerant flowing through the intermediate passage (P27) and the air conveyed by the cooling fan (13) to the intercooler (43). Thus, the refrigerant flowing through the intermediate passage (P27) is cooled. For example, the intercooler (43) is a fin-and-tube heat exchanger.

<First Heat Source Expansion Valve>

The first heat source expansion valve (44*a*) is provided in the third heat source passage (P43), and decompresses the refrigerant. In this example, the first heat source expansion valve (44*a*) is arranged in the third heat source passage (P43) between the first intermediate portion (Q31) and the second intermediate portion (Q32). The first heat source expansion valve (44*a*) has a variable opening degree. For example, the first heat source expansion valve (44*a*) is an electronic expansion valve (motor-operated valve).

<Second Heat Source Expansion Valve>

The second heat source expansion valve (44*b*) is provided in the fifth heat source passage (P45), and decompresses the refrigerant. The second heat source expansion valve (44*b*) has a variable opening degree. For example, the second heat source expansion valve (44*h*) is an electronic expansion valve (motor-operated valve).

<Cooling Expansion Valve>

The cooling expansion valve (45) is provided in the sixth heat source passage (P46), and decompresses the refrigerant. In this example, the cooling expansion valve (45) is arranged in the sixth heat source passage (P46) between one end of the sixth heat source passage (P46) (the second intermediate portion (Q42) of the fourth heat source passage (P44)) and the cooling heat exchanger (42). The cooling expansion valve (45) has a variable opening degree. For example, the cooling expansion valve (45) is an electronic expansion valve (motor-operated valve).

<Venting Valve>

The venting valve (46) is provided in the seventh heat source passage (P47). The venting valve (46) has a variable opening degree. For example, the cooling expansion valve (45) is a motor-operated valve. The venting valve (46) may be an on-off valve (electromagnetic valve) that is switchable between an open state and a closed state.

<Pressure Release Valve>

The pressure release valve (RV) is operated when the pressure (RP) in the receiver (41) exceeds a predetermined operating pressure. In this example, the pressure release valve (RV) is provided for the receiver (41). When the pressure release valve (RV) is operated, the refrigerant in the receiver (41) is discharged from the receiver (41) through the pressure release valve (RV).

<Check Valve>

The heat source circuit (11) is provided with first to seventh check valves (CV1 to CV7). The first check valve (CV1) is provided in the first discharge passage (P24), The second check valve (CV2) is provided in the second discharge passage (P25). The third check valve (CV3) is provided in the third discharge passage (P26). The fourth check valve (CV4) is provided for the third heat source passage (P43), and is arranged in the third heat source passage (P43) between the first heat source expansion valve (44*a*) and the second intermediate portion (Q32), The fifth check valve (CV5) is provided in the fourth heat source passage (P44), and is arranged in the first branch passage (P44*b*) of the fourth heat source passage (P44) between the third intermediate portion (Q43) and a junction of the main passage (P44*a*), the first branch passage (P44*b*), and the second branch passage (P44*c*). The sixth check valve (CV6) is provided in the fifth heat source passage (P45), and is arranged in the fifth heat source passage (P45) between one end of the fifth heat source passage (P45) (the first intermediate portion (Q31) of the fourth heat source passage (P44)) and the second heat source expansion valve (44*b*). The seventh check valve (CV7) is provided in the eighth heat source passage (P48). Each of the first to seventh check valves (CV1 to CV7) allows the refrigerant to flow in the direction of the arrows shown in FIG. 1 and prohibits the refrigerant to flow in the opposite direction.

<Oil Separation Circuit>

The heat source circuit (11) is provided with an oil separation circuit (50). The oil separation circuit (50) includes an oil separator (60), a first oil return pipe (61), a second oil return pipe (62), a first oil control valve (63), and a second oil control valve (64). The oil separator (60) is provided in the third discharge passage (P26), and separates oil from the refrigerant discharged from the compression element (20), i.e., the third compressor (23). One end of the first oil return pipe (61) is connected to the oil separator (60), and the other end of the first oil return pipe (61) is connected to the first suction passage (P21). One end of the second oil return pipe (62) is connected to the oil separator (60), and the other end of the second oil return pipe (62) is connected to the second suction passage (P22). The first oil control valve (63) is provided in the first oil return pipe (61), and the second oil control valve (64) is provided in the second oil return pipe (62).

With this configuration, part of the oil collected in the oil separator (60) returns to the first compressor (21) through the first oil return pipe (61) and the first suction passage (P21), and the remainder returns to the second compressor (22) through the second oil return pipe (62) and the second suction passage (P22). The oil collected in the oil separator (60) may return to the third compressor (23). Alternatively, the oil collected in the oil separator (60) may directly return to an oil reservoir (not shown) in the casing of the first compressor (21), an oil reservoir (not shown) in the casing of the second compressor (22), or an oil reservoir (not shown) in the casing of the third compressor (23).

[Various Sensors in Heat Source Unit]

The heat source unit (10) is provided with various sensors, such as a pressure sensor and a temperature sensor. The various sensors detect physical quantities, such as the pressure and temperature of a high-pressure refrigerant in the refrigerant circuit (100), the pressure and temperature of a low-pressure refrigerant in the refrigerant circuit (100), the pressure and temperature of an intermediate-pressure refrigerant in the refrigerant circuit (100), the pressure and temperature of a refrigerant in the heat source heat exchanger (40), and the temperature of the air (outdoor air in this example) sucked into the heat source unit (10).

In this example, the heat source unit (10) is provided with a first suction pressure sensor (S21), a second suction pressure sensor (S22), and a discharge pressure sensor (S23). Specifically, the first suction pressure sensor (S21) is provided near the suction port of the first compressor (21) in the first suction passage (P21). The second suction pressure sensor (S22) is provided near the suction port of the second compressor (22) in the second suction passage (P22). The discharge pressure sensor (S23) is provided in the third discharge passage (P26). The first suction pressure sensor (S21) detects the pressure of the refrigerant on the suction side of the first compressor (21) (an example of the suction side of the compression element (20)). The second suction pressure sensor (S22) detects the pressure of the refrigerant on the suction side of the second compressor (22) (an example of the suction side of the compression element (20)). The discharge pressure sensor (S23) detects the pressure of the refrigerant on the discharge side of the third compressor (23) (an example of the discharge side of the compression element (20)).

[Heat Source Controller]

The heat source controller (14) is connected to the various sensors (i.e., the first suction pressure sensor (S21), the second suction pressure sensor (S22), the discharge pressure sensor (S23), etc.) provided in the heat source unit (10) via communication lines. The heat source controller (14) is connected to the components of the heat source unit (10) (i.e., the compression element (20), the switching unit (30), the first heat source expansion valve (44*a*), the second heat source expansion valve (44*b*), the cooling expansion valve (45), the venting valve (46), the heat source fan (12), the cooling fan (13), etc.), via communication lines. The heat source controller (14) controls the components of the heat source unit (10) based on detection signals of the various sensors provided in the heat source unit (10) (signals indicating detection results of the various sensors) and external signals (e.g., operation commands). For example, the heat source controller (14) includes a processor and a memory that stores programs and information for operating the processor.

[Utilization Circuit]

The utilization circuit (16) includes a utilization heat exchanger (70) and a utilization expansion valve (71). The utilization circuit (16) also includes a utilization gas passage (P70) and a utilization liquid passage (P71). The utilization gas passage (P70) and the utilization liquid passage (P71) are formed by, for example, refrigerant pipes.

In this example, the utilization circuit (16) of the utilization unit (15) constituting the indoor unit (15*a*) includes, in addition to the utilization heat exchanger (70) and the utilization expansion valve (71), an auxiliary expansion valve (72), an eighth check valve (018), and a ninth check valve (019). The utilization circuit (16) of the utilization unit (15) constituting the indoor unit (15*a*) further includes an auxiliary passage (P72) in addition to the utilization gas passage (P70) and the utilization liquid passage (P71).

<Utilization Fan and Utilization Heat Exchanger>

The utilization fan (17) is arranged near the utilization heat exchanger (70) and conveys the air (room air or air inside the cold storage in this example) to the utilization heat exchanger (70). The utilization heat exchanger (70) exchanges heat between the refrigerant flowing through the utilization heat exchanger (70) and the air conveyed by the utilization fan (17) to the utilization heat exchanger (70). For example, the utilization heat exchanger (70) is a fin-and-tube heat exchanger.

In this example, a gas end of the utilization heat exchanger (70) is connected to one end of the utilization gas passage (P70), and the other end of the utilization gas passage (P70) is connected to the other end of the gas connection pipe (P11). Specifically, the other end of the utilization gas passage (P70) of the utilization circuit (16) of the indoor unit (15*a*) is connected to the other end of the first gas connection pipe (P13), and the other end of the utilization gas passage (P70) of the utilization circuit (16) of the cold storage unit (15*b*) is connected to the other end of the second gas connection pipe (P15). The liquid end of the utilization heat exchanger (70) is connected to one end of the utilization liquid passage (P71), and the other end of the utilization liquid passage (P71) is connected to the other end of the liquid connection pipe (P12). Specifically, the other end of the utilization liquid passage (P71) of the utilization circuit (16) of the indoor unit (15*a*) is connected to the other end of the first liquid connection pipe (P14), and the other end of the utilization liquid passage (P71) of the utilization circuit (16) of the cold storage unit (15*h*) is connected to the other end of the second liquid connection pipe (P16).

<Utilization Expansion Valve>

The utilization expansion valve (71) is provided in the utilization liquid passage (P71), and decompresses the refrigerant. The utilization expansion valve (71) has a variable opening degree. For example, the utilization expansion valve (71) is an electronic expansion valve (motor-operated valve).

<Auxiliary Expansion Valve=

The auxiliary expansion valve (72) is provided in the auxiliary passage (P72), and decompresses the refrigerant. The auxiliary expansion valve (72) has a variable opening degree. For example, the auxiliary expansion valve (72) is an electronic expansion valve (motor-operated valve).

In this example, in the utilization circuit (16) of the indoor unit 5*a*), one end of the auxiliary passage (P72) is connected to the liquid end of the utilization heat exchanger (70), and the other end of the auxiliary passage (P72) is connected to the other end of the first liquid connection pipe (P14).

<Check Valve>

In the utilization circuit (16) of the indoor unit (15*a*), the eighth check valve (CV8) is provided in the utilization liquid passage (P71), and is arranged in the utilization liquid passage (P71) between the liquid end of the heat source heat exchanger (40) and the utilization expansion valve (71). The ninth check valve (CV9)) is provided in the auxiliary passage (P72), and is arranged in the auxiliary passage (P72) between the auxiliary expansion valve (72) and the other end of the first liquid connection pipe (P14). Each of the eighth check valve (CV8) and the ninth check valve (CV9) allows the refrigerant to flow in the direction of the arrows shown in FIG. 1 and prohibits the refrigerant from flowing in the opposite direction.

[Various Sensors in Utilization Unit]

Each utilization unit (15) is provided with various sensors, such as a pressure sensor and a temperature sensor (not shown). The various sensors detect physical quantities, such as the pressure and temperature of the high-pressure refrigerant in the refrigerant circuit (100), the pressure and temperature of the low-pressure refrigerant in the refrigerant circuit (100), the pressure and temperature of the refrigerant in the utilization heat exchanger (70), and the temperature of the air (the room air or the air inside the cold storage in this example) sucked into the utilization unit (15).

[Utilization Controller]

The utilization controller (18) is connected to the various sensors (i.e., the pressure sensors, the temperature sensors, etc.) provided in the utilization unit (15) via communication lines. The utilization controller (18) is connected to the components of the utilization unit (15) (i.e., the utilization expansion valve (71), the auxiliary expansion valve (72), the utilization fan (17), etc.) via communication lines. The utilization controller (18) controls the components of the utilization unit (15) based on detection signals of the various sensors provided in the utilization unit (15) (signals indicating detection results of the various sensors) and external signals (e.g., operation commands), For example, the utilization controller (18) adjusts the opening degree of the utilization expansion valve (71) by superheat control. For the superheat control, the utilization controller (18) adjusts the opening degree of the utilization expansion valve (71) so that the degree of superheat of the refrigerant at the outlet of the utilization heat exchanger (70) serving as an evaporator reaches a target degree of superheat. For example, the utilization controller (18) includes a processor and a memory that stores programs and information for operating the processor.

[Relationship Between Heat Source Controller and Utilization Controlled]

The heat source controller (14) and utilization controller (18) of the refrigeration apparatus (1) are not connected to each other via communication lines, and do not communicate with each other. The heat source controller (14) controls the components of the heat source unit (10) solely. The utilization controller (18) controls the components of the utilization unit (15) solely. The heat source controller (14) and utilization controller (18) of the refrigeration apparatus (1) are connected to each other via a signal line that transmits a drive permission signal (SE), which will be described later. Details of the heat source controller (14) and the utilization controller (18) will be described later.

[Operation of Refrigeration Apparatus]

The refrigeration apparatus (1) shown in FIG. 1 performs various operations, such as a cold storage running operation, a cooling operation, a cooling and cold storage running operation, a heating operation, and a heating and cold storage running operation, <Cold Storage Running Operation>

The cold storage running operation will be described with reference to FIG. 2, In the cold storage running operation, the cold storage unit (15*b*) is operated and the indoor unit (15*a*) is stopped. In the cold storage running operation, a refrigeration cycle occurs in which the heat source heat exchanger (40) serves as a radiator, and the utilization heat exchanger (70) of the cold storage unit (15*b*) serves as an evaporator.

In the heat source unit (10) in the cold storage running operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The second compressor (22) and the third compressor (23) are driven, and the first compressor (21) is stopped. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is stopped, and the utilization expansion valve (71) and the auxiliary expansion valve (72) are fully closed. In the cold storage unit (15*b*), the utilization fan (17) is driven, and the opening degree of the utilization expansion valve (71) is adjusted by superheat control.

Figure 2:
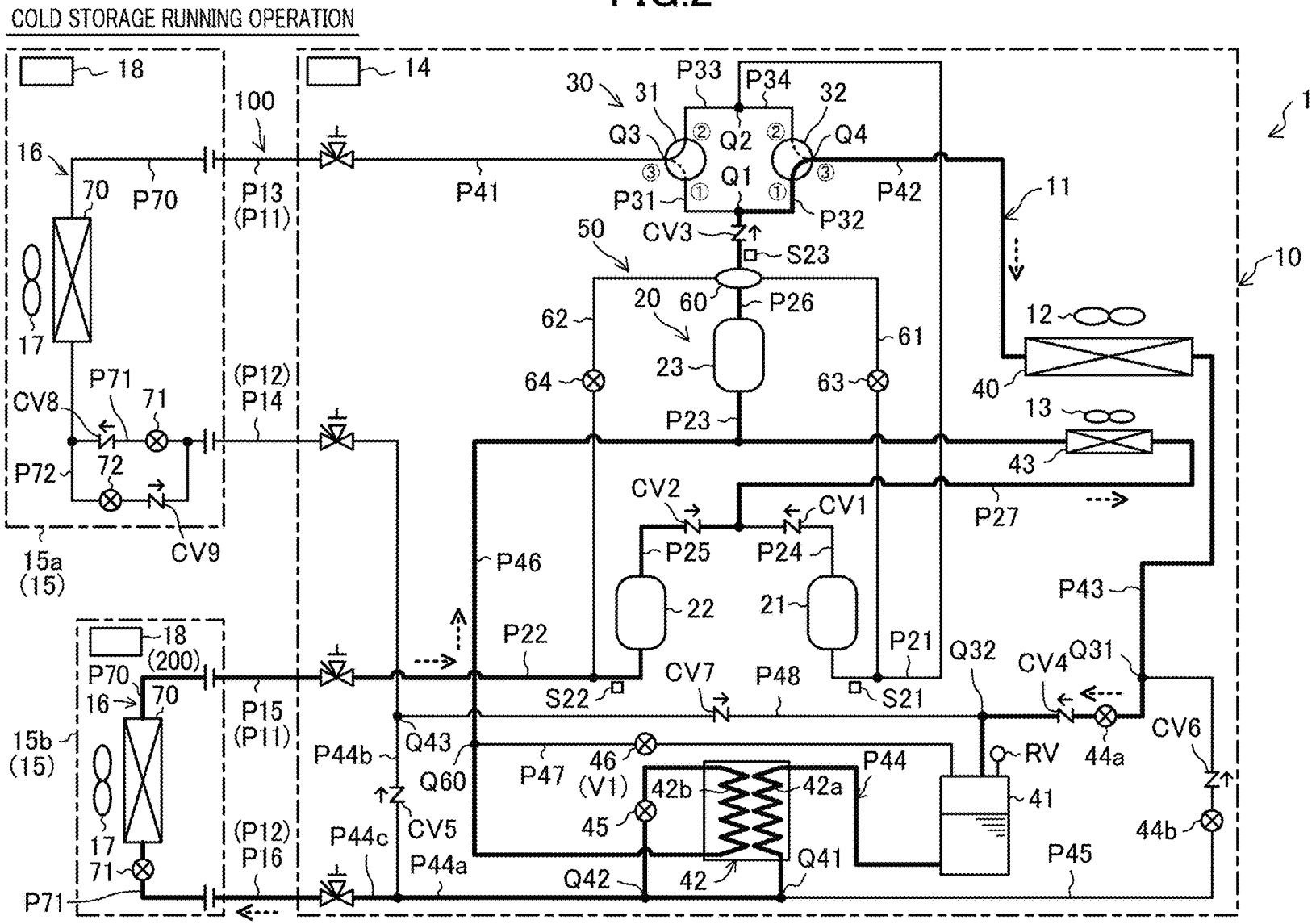
FIG. 2 is a piping system diagram illustrating how a refrigerant flows in a cold storage running operation.

As illustrated in FIG. 2, the refrigerant discharged from the second compressor (22) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (014) which are open in the third heat source passage (P43), and flows into the receiver (41) to be collected therein. The refrigerant that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the sixth heat source passage (P46), and the remainder flows into the utilization liquid passage (P71) of the cold storage unit (15*b*) via the fourth heat source passage (P44) and the second liquid connection pipe (P16).

The refrigerant that has flowed into the utilization liquid passage (P71) of the cold storage unit (15*b*) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23), <Cooling Operation>

The cooling operation will be described with reference to FIG. 3. In the cooling operation, the indoor unit (15*a*) cools the inside of the room, and the cold storage unit (15*b*) is stopped. In the cooling operation, a refrigeration cycle occurs in which the heat source heat exchanger (40) serves as a radiator, and the utilization heat exchanger (70) of the indoor unit (15*a*) serves as an evaporator.

In the heat source unit (10) in the cooling operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The first compressor (21) and the third compressor (23) are driven, and the second compressor (22) is stopped. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is driven, the opening degree of the utilization expansion valve (71) is adjusted by superheat control, and the auxiliary expansion valve (72) is fully closed. In the cold storage unit (15*b*), the utilization fan (17) is stopped and the utilization expansion valve (71) is fully closed.

Figure 3:
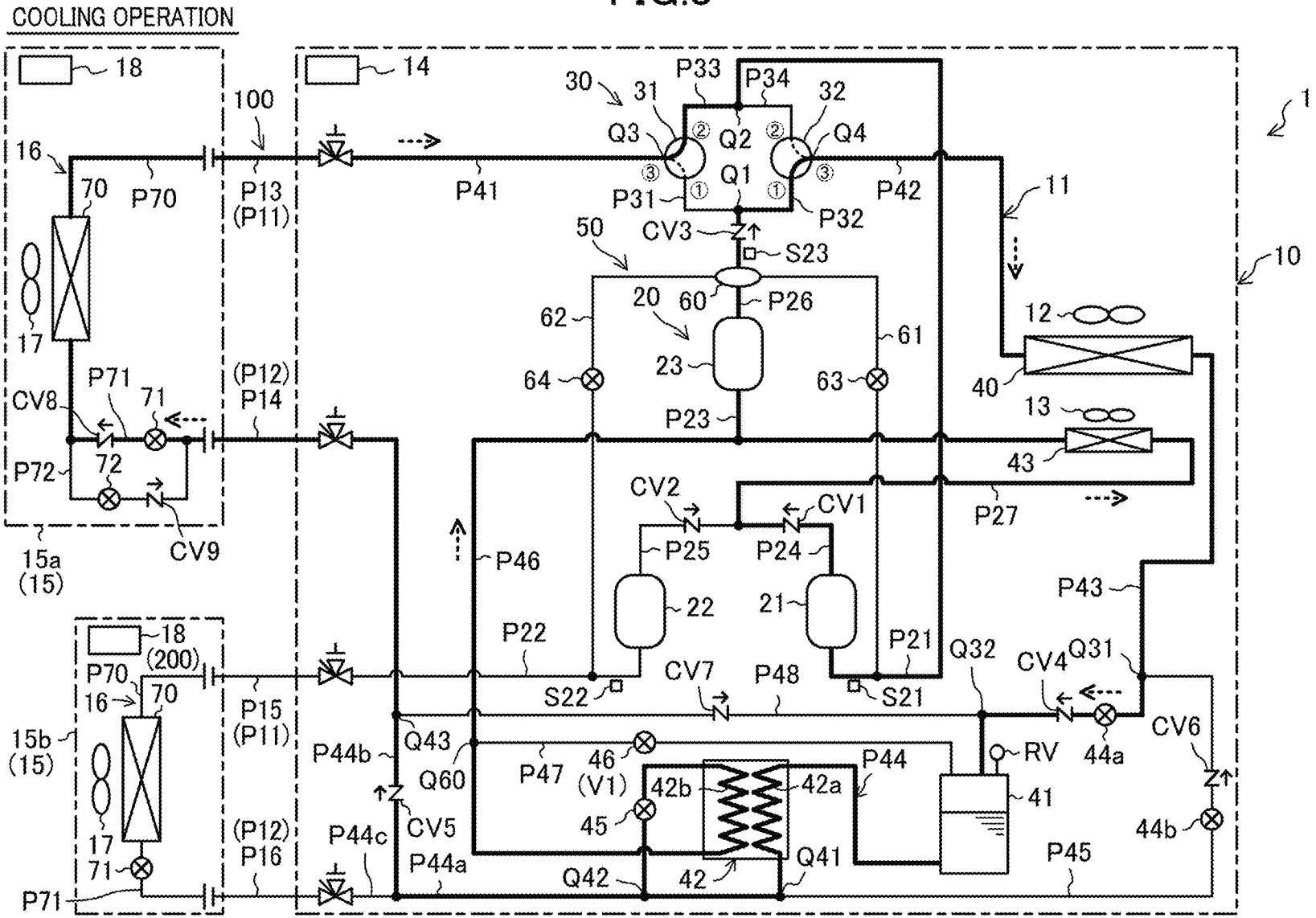
FIG. 3 is a piping system diagram illustrating how the refrigerant flows in a cooling operation.

As illustrated in FIG. 3, the refrigerant discharged from the first compressor (21) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (074) which are open in the third heat source passage (P43), and flows into the receiver (41) to be collected therein. The refrigerant that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*h*) of the cooling heat exchanger (42). Part of the refrigerant that has flowed out of the first refrigerant passage (42*a*) of the cooling heat exchanger (42) flows into the sixth heat source passage (P46), and the remainder flows into the utilization liquid passage (P71) of the indoor unit (15*a*) via the fourth heat source passage (P44) and the first liquid connection pipe (P14).

The refrigerant that has flowed into the utilization liquid passage (P71) of the indoor unit (15*a*) is decompressed by the utilization expansion valve (71), and absorbs heat from the room air in the utilization heat exchanger (70) to evaporate. Thus, the room air is cooled. The refrigerant that has flowed out of the utilization heat exchanger (70) passes through the utilization gas passage (P70), the first gas connection pipe (P13), the first heat source passage (P41), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Cooling and Cold Storage Running Operation>

The cooling and cold storage running operation will be described with reference to FIG. 4. In the cooling and cold storage running operation, the indoor unit (15*a*) cools the inside of the room, and the cold storage unit (15*b*) runs. In the cooling and cold storage running operation, a refrigeration cycle occurs in which the heat source heat exchanger (40) serves as a radiator, and the utilization heat exchanger (70) of the indoor unit (15*a*) and the utilization heat exchanger (70) of the cold storage unit (15*b*) serve as evaporators.

In the heat source unit (10) in the cooling and cold storage running operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The first compressor (21), the second compressor (22), and the third compressor (23) are driven. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is driven, the opening degree of the utilization expansion valve (71) is adjusted by superheat control, and the auxiliary expansion valve (72) is fully closed. In the cold storage unit (15*b*), the utilization fan (17) is driven, and the opening degree of the utilization expansion valve (71) is adjusted by superheat control.

Figure 4:
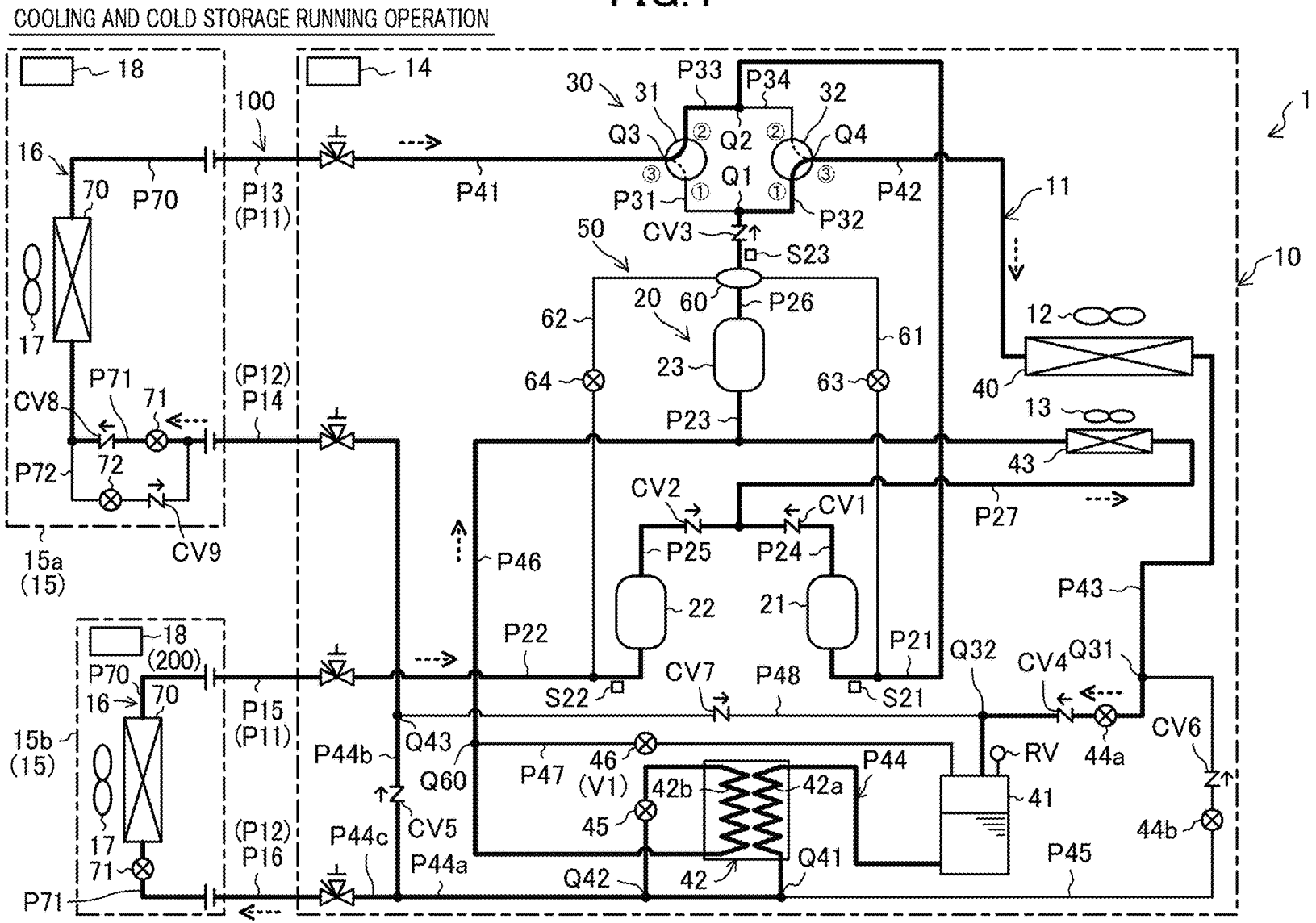
FIG. 4 is a piping system diagram illustrating how the refrigerant flows in a cooling and cold storage running operation.

As illustrated in FIG. 4, the refrigerant discharged from each of the first compressor (21) and the second compressor (22) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (CV4) which are open in the third heat source passage (P43), and flows into the receiver (41) to be collected therein. The refrigerant that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the sixth heat source passage (P46), and the remainder diverges into the first liquid connection pipe (P14) and the second liquid connection pipe (P16). The refrigerant that has diverged into the first liquid connection pipe (P14) flows into the utilization liquid passage (P71) of the indoor unit (15*a*). The refrigerant that has diverged into the second liquid connection pipe (P16) flows into the utilization liquid passage (P71) of the cold storage unit (15*b*).

The refrigerant that has flowed into the utilization liquid passage (P71) of the indoor Lunt (15*a*) is decompressed by the utilization expansion valve (71), and absorbs heat from the room air in the utilization heat exchanger (70) to evaporate. Thus, the room air is cooled. The refrigerant that has flowed out of the utilization heat exchanger (70) passes through the utilization gas passage (P70), the first gas connection pipe (P13), the first heat source passage (P41), the switching unit (30), and the first suction passage (P21), and is sucked into and compressed by the first compressor (21).

The refrigerant that has flowed into the utilization liquid passage (P71) of the cold storage unit (15*b*) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) acid the third suction passage (P23), and is sucked into and compressed by the third compressor (23).

<Heating Operation>

The heating operation will be described with reference to FIG. 5. In the heat operation, the indoor unit (15*a*) heats the inside of the room, and the cold storage unit (15*b*) is stopped. In the heating operation, a refrigeration cycle occurs in which the utilization heat exchanger (70) of the indoor unit (15*a*) serves as a radiator, and the heat source heat exchanger (40) serves as an evaporator.

In the heat source unit (10) in the heating operation, the first three-way valve (31) is brought into the first state, and the second three-way valve (32) is brought into the second state. This allows the first port (Q1) and third port (Q3) of the switching unit (30) to communicate with each other, and allows the second port (Q2) and the fourth port (Q4) to communicate with each other. The heat source fan (12) is driven, and the cooling fan (13) is stopped. The first compressor (21) and the third compressor (23) are driven, and the second compressor (22) is stopped. The opening degree of the second heat source expansion valve (44*b*) is adjusted by superheat control, the first heat source expansion valve (44*a*) and the venting valve (46) are fully closed, and the opening degree of the cooling expansion valve (45) is suitably adjusted. In the indoor unit (15*a*), the utilization fan (17) is driven, the utilization expansion valve (71) is fully closed, and the auxiliary expansion valve (72) is opened at a predetermined opening degree. In the cold storage unit (15*b*), the utilization fan (17) is stopped and the utilization expansion valve (71) is fully closed.

Figure 5:
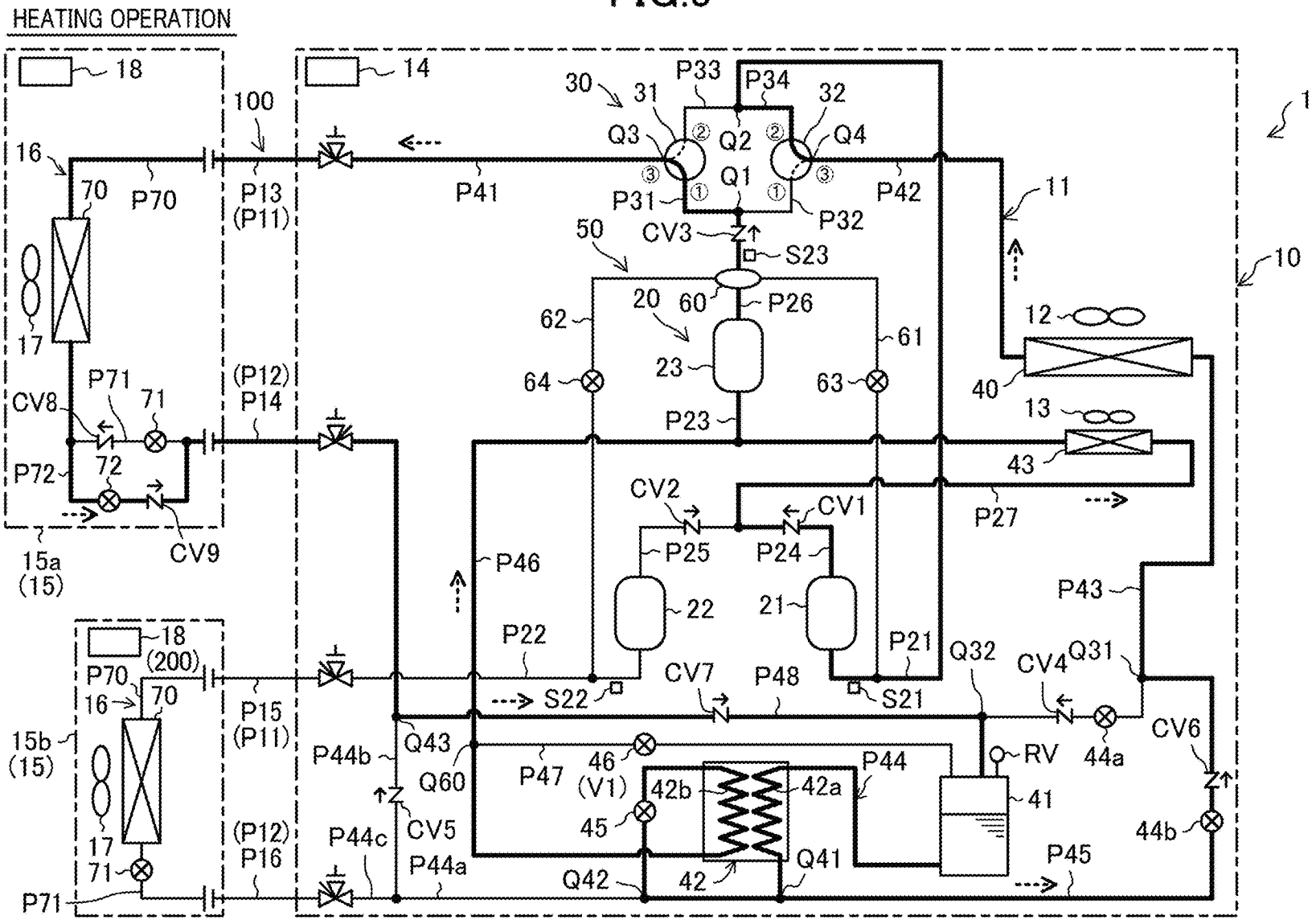
FIG. 5 is a piping system diagram illustrating how the refrigerant flows in a heating operation.

As illustrated in FIG. 5, the refrigerant discharged from the first compressor (21) flows through the intercooler (43), and is sucked into and compressed by the third compressor (23). The refrigerant discharged from the third compressor (23) passes through the switching unit (30), the first heal source passage (P41), and the first gas connection pipe (P13), and flows into the utilization gas passage (P70) of the indoor unit (15*a*).

The refrigerant that has flowed into the utilization gas passage (P70) of the indoor unit (0.15*a*) dissipates heat to the room air in the utilization heat exchanger (70). Thus, the room air is heated. The refrigerant that has flowed out of the utilization heat exchanger (70) passes through the auxiliary expansion valve (72) and the ninth check valve (CV9) which are open in the auxiliary passage (P72), and flows into the fourth heat source passage (P44) of the heat source unit (10) via the first liquid connection pipe (P14).

The refrigerant that has flowed into the fourth heat source passage (P44) in the heat source unit (10) passes through the eighth heat source passage (P48) and the third heat source passage (P43), and flows into the receiver (41) to be collected therein. The refrigerant that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the fifth heat source passage (P45), and the remainder flows into the sixth heat source passage (P46).

The refrigerant that has flowed into the fifth heat source passage (P45) in the heat source unit (10) is decompressed by the second heat source expansion valve (44*b*), flows into the heat source heat exchanger (40) via the third heat source passage (P43), and absorbs heat from the outdoor air in the heat source heat exchanger (40) to evaporate. The refrigerant that has flowed out of the heat source heat exchanger (40) passes through the second heat source passage (P42), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Heating and Cold Storage Running Operation>

Figure 6:
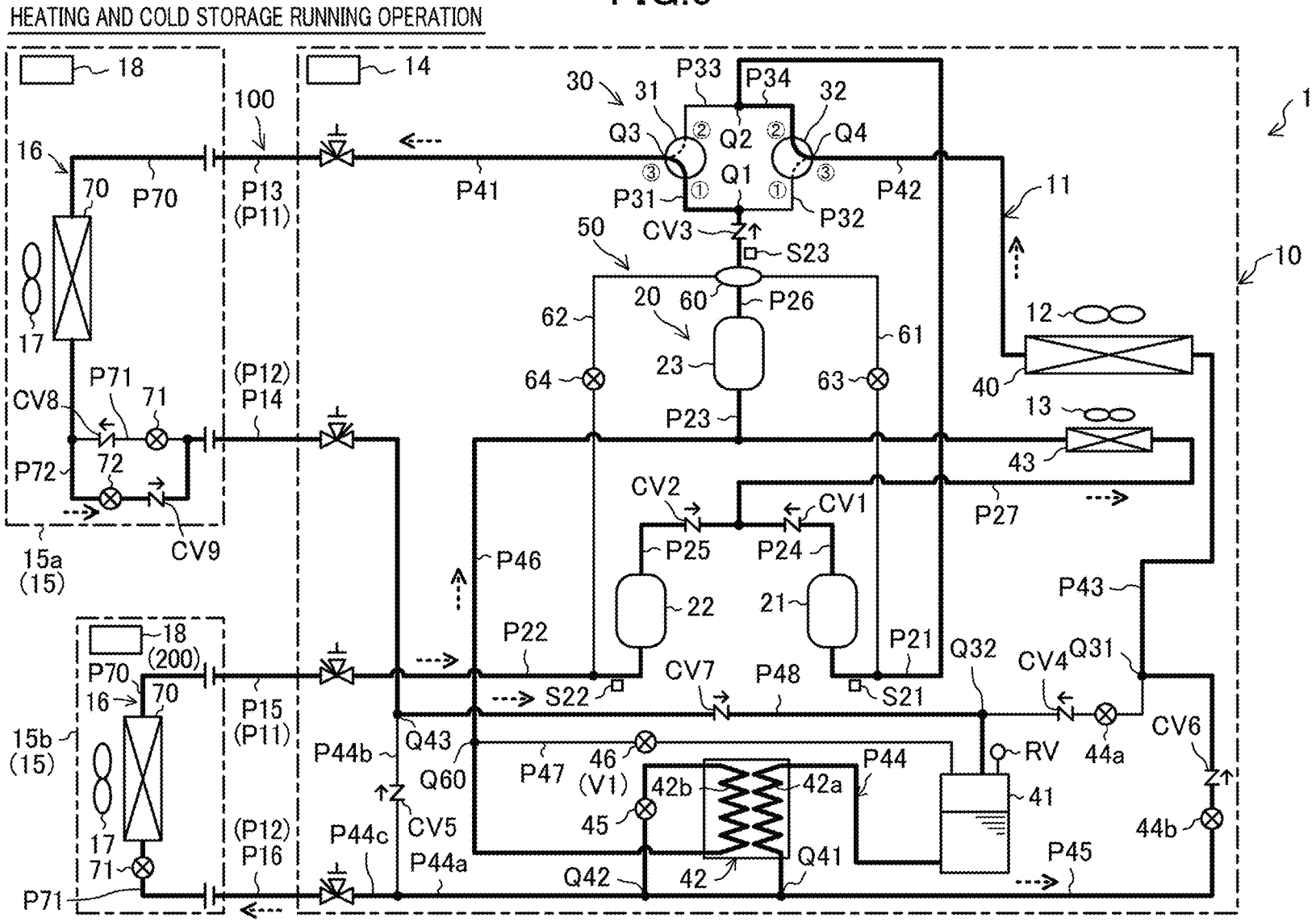
FIG. 6 is a piping system diagram illustrating how the refrigerant flows in a heating and cold storage running operation.

The heating and cold storage running operation will be described with reference to FIG. 6. In the heating and cold storage running operation, the indoor unit (15*a*) heats the inside of the room, and the cold storage unit (15*b*) runs. In the heating and cold storage running operation, a refrigeration cycle occurs in which the utilization heat exchanger (70) of the indoor unit (15*a*) serves as a radiator, and the heat source heat exchanger (40) and the utilization heat exchanger (70) of the cold storage unit (15*b*) serve as evaporators.

In the heating and cold storage running operation, the first three-way valve (31) is brought into the first state, and the second three-way valve (32) is brought into the second state. The heat source fan (12) is driven, and the cooling fan (13) is stopped. The first port (Q1) and the third port (Q3) of the switching unit (30) communicate with each other, and the second port (Q2) and the fourth port (Q4) communicate with each other. The first compressor (21), the second compressor (22), and the third compressor (23) are driven. The opening degree of the second heat source expansion valve (44*b*) is adjusted by superheat control, the first heat source expansion valve (44*a*) and the venting valve (46) are fully closed, and the opening degree of the cooling expansion valve (45) is suitably adjusted. In the indoor unit (15*a*), the utilization fan (17) is driven, the utilization expansion valve (71) is fully closed, and the auxiliary expansion valve (72) is opened at a predetermined opening degree. In the cold storage unit (15*h*), the utilization fan (17) is driven, and the opening degree of the utilization expansion valve (71) is adjusted by superheat control.

In the heating and cold storage running operation, the refrigerant discharged from each of the first compressor (21) and the second compressor (22) flows through the intercooler (43), and is sucked into and compressed by the third compressor (23). The refrigerant discharged from the third compressor (23) passes through the switching unit (30), the first heat source passage (P41), and the first gas connection pipe (P13), and flows into the utilization gas passage (P70) of the indoor unit (15*a*).

The refrigerant that has flowed into the utilization gas passage (P70) of the indoor unit (15*a*) dissipates heat to the room air in the utilization heat exchanger (70). Thus, the room air is heated. The refrigerant that has flowed out of the utilization heat exchanger (70) passes through the auxiliary expansion valve (72) and the ninth check valve (CV9) which are open in the auxiliary passage (P72), and flows into the fourth heat source passage (P44) of the heat source unit (10) via the first liquid connection pipe (P14).

The refrigerant that has flowed into the fourth heat source passage (P44) in the heat source unit (10) passes through the eighth heat source passage (P48) and the third heat source passage (P43), and flows into the receiver (41) to be collected therein. The refrigerant that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the fifth heat source passage (P45), and the remainder diverges into the second liquid connection pipe (P16) and the sixth heat source passage (P46). The refrigerant that has diverged into the second liquid connection pipe (P16) flows into the utilization liquid passage (P71) of the cold storage unit (15*b*).

The refrigerant that has flowed into the fifth heat source passage (P45) in the heat source unit (10) is decompressed by the second heat source expansion valve (44*b*), flows into the heat source heat exchanger (40) via the third heat source passage (P43), and absorbs heat from the outdoor air in the heat source heat exchanger (40) to evaporate. The refrigerant that has flowed out of the heat source heat exchanger (40) passes through the second heat source passage (P42), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

The refrigerant that has flowed into the utilization liquid passage (P71) of the cold storage unit (I Sb) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

<Details of Heat Source Controller>

Figure 7:
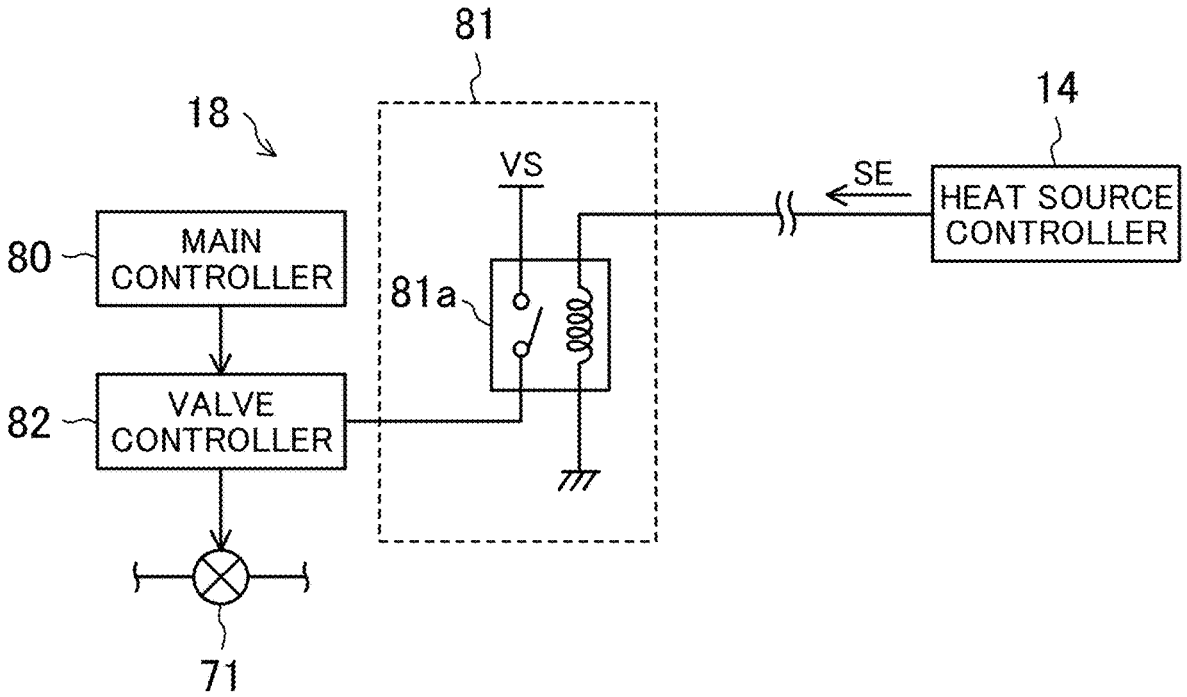
FIG. 7 is a block diagram illustrating configurations of a heat source controller and a utilization controller.

As illustrated in FIG. 7, the heat source controller (14) of the refrigeration apparatus (1) transmits a drive permission signal (SE) to the utilization controller (18). The drive permission signal (SE) is a signal indicating that the compression element (20) is drivable. Specifically, the heat source controller (14) transmits the drive permission signal (SE) to the utilization controller (18) when the compression element (20) is drivable. The heat source controller (14) does not transmit the drive permission signal (SE) when the compression element (20) is undrivable. In this example, the heat source controller (14) does not transmit the drive permission signal (SE) when the heat source unit (10) is unable to operate normally. The heat source unit (10) is unable to operate normally, for example, during a power failure of the heat source unit (10), during maintenance of the heat source unit (10), when the pressure of the refrigerant in the heat source unit (10) is abnormal, and when the temperature of the refrigerant discharged from the compression element (20) of the heat source unit (10) is abnormal. In this example, the heat source controller (14) transmits the drive permission signal (SE) to the utilization controller (18) of each of the plurality of utilization units (15) (i.e., the indoor unit (15*a*) and the cold storage unit (15*b*)) connected to the heat source unit (10).

The heat source controller (14) drives the compression element (20) when the compression element (20) is in a stopped state and the pressure (LP) of the refrigerant on the suction side of the compression element (20) (will be hereinafter referred to as "suction pressure (LP)") exceeds a predetermined first pressure (LPth1). The suction pressure (LP) of the compression element (20) is detected by the first suction pressure sensor (S21) and the second suction pressure sensor (S22). For example, the first pressure (LPth1) may be set to a pressure at which the utilization expansion valve (71) of at least one of the utilization units (15) is open and it can be considered that heat exchange is occurring in the utilization heat exchanger (70). Alternatively, the first pressure (LPth1) may be set to a pressure at which it can be considered that the refrigerant flowing from the utilization heat exchanger (70) through the suction passage (the first suction passage (P21) or the second suction passage (P22)) accumulates near the suction port of the compressor (the first compressor (21) or the second compressor (22)).

The heat source controller (14) stops the compression element (20) when the suction pressure (LP) of the compression element (20) falls below a predetermined second pressure (LPth2) while the compression element (20) is driven. The second pressure (LPth2) is lower than the first pressure (LPth1). For example, the second pressure (LPth2) may be set to a pressure at which the utilization expansion valve (71) of every utilization unit (15) is considered to be open.

[Details of Utilization Controller]

In the refrigeration apparatus (I), the utilization controller (18) opens the utilization expansion valve (71) when the heat exchange in the utilization heat exchanger (70) is required, on condition that the utilization controller (18) receive the drive permission signal (SE).

Specifically, the utilization controller (18) opens the utilization expansion valve (71) when the utilization controller (18) has received the drive permission signal (SE) and the heat exchange in the utilization heat exchanger (70) is required. The utilization controller (18) adjusts the opening degree of the utilization expansion valve (71) as necessary. For example, the utilization controller (18) adjusts the opening degree of the utilization expansion valve (71) by superheat control. The utilization controller (18) fully closes the utilization expansion valve (71) when the utilization controller (18) has received the drive permission signal (SE) and the heat exchange in the utilization heat exchanger (70) is no longer necessary. The utilization controller (18) does not open the utilization expansion valve (71) when the utilization controller (18) receives no drive permission signal (SE), even if the heat exchange in the utilization heat exchanger (70) is required. More specifically, when the utilization controller (18) receives no drive permission signal (SE), the utilization controller (18) fully closes the utilization expansion valve (71) regardless of whether the heat exchange in the utilization heat exchanger (70) is required.

As illustrated in FIG. 7, the utilization controller (18) of this example includes a main controller (80), a receiving section (81), a valve controller (82).

<Main Controller>

The main controller (80) performs various types of control for controlling the components of the utilization units (15). In this example, the main controller (80) performs various types of control, such as temperature control and fan control. For example, the main controller (80) includes a processor and a memory that stores programs and information for operating the processor.

For the temperature control, the main controller (80) determines whether the heat exchange in the utilization heat exchanger (70) is required. Determining that the heat exchange in the utilization heal exchanger (70) is required, the main controller (80) transmits an instruction signal for opening the utilization expansion valve (71) to the valve controller (82).

Whether the heat exchange in the utilization heat exchanger (70) is necessary may be determined based on the temperature of the air (the room air or the air inside the cold storage in this example) sucked into the utilization unit (15). For example, for cooling the air by the utilization unit (15), the utilization controller (18) determines that the heat exchange in the utilization heat exchanger (70) is required when the temperature of the air sucked into the utilization unit (15) exceeds a preset target temperature. The utilization controller (18) determines that the heat exchange in the utilization heat exchanger (70) is no longer necessary when the temperature of the air sucked into the utilization unit (15) is lowered to the target temperature.

For the fan control, the main controller (80) controls the utilization fan (17). Specifically, the main controller (80) controls start, stop, and the number of rotations of the utilization fan (17).

A power source voltage is supplied to the main controller (80) without passing through a relay (81*a*) which will be described later. For example, a power source voltage (VS) to be described later may be supplied to the main controller (80) without passing through the relay (81*a*). Alternatively, a power source voltage different from the power source voltage (VS) may be supplied to the main controller (80). In other words, a power source system that supplies the power source voltage to the main controller (80) may be different from a power source system that supplies the power source voltage (VS).

[Receiving Section]

The receiving section (81) receives the drive permission signal (SE).

In this example, the receiving section (81) includes the relay (81*a*), The relay (81*a*) is closed when energized, and is opened when deenergized. When the receiving section (81) receives the drive permission signal (SE), the relay (81*a*) is energized and closed. In this example, the drive permission signal (SE) is a contact signal that causes the relay (81*a*) to be energized and closes the relay (81*a*). Specifically, the relay (81*a*) includes a contact that can be opened and closed and a coil that opens and closes the contact. When the contact signal is supplied and the coil is energized, the coil starts a closing operation for closing the contact. When the supply of the contact signal continues, the coil continues the closing operation. Then, when the supply of the contact signal is stopped and the coil is deenergized, the coil ends the closing operation.

In this example, the receiving section (81) is configured to supply the power source voltage (VS) to the valve controller (82) in accordance with the opening and closing of the relay (81*a*). The power source voltage (VS) is a voltage for operating the valve controller (82). In this example, the power source voltage (VS) is supplied to the valve controller (82) when the relay (81*a*) is closed, and no power source voltage (VS) is supplied to the valve controller (82) when the relay (81*a*) is opened.

<Valve Controller>

The valve controller (82) opens the utilization expansion valve (71) when the heat exchange in the utilization heat exchanger (70) is required, on condition that the receiving section (81) receive the drive permission signal (SE). In this example, determining that the heat exchange in the utilization heat exchanger (70) is required, the main controller (80) transmits an instruction signal for opening the utilization expansion valve (71) to the valve controller (82). When the receiving section (81) has received the drive permission signal (SE), the valve controller (82) opens the utilization expansion valve (71) upon receiving an instruction signal (instruction signal for opening the utilization expansion valve (71)) transmitted from the main controller (80). For example, the valve controller (82) includes a processor and a memory that stores programs and information for operating the processor.

Specifically, the valve controller (82) opens the utilization expansion valve (71) when the receiving section (81) has received the drive permission signal (SE) and the heat exchange in the utilization heat exchanger (70) is required. The valve controller (82) adjusts the opening degree of the utilization expansion valve (71) as necessary. The valve controller (82) fully closes the utilization expansion valve (71) when the receiving section (81) has received the drive permission signal (SE) and the heat exchange in the utilization heat exchanger (70) is no longer necessary. The valve controller (82) does not open the utilization expansion valve (71) when the receiving section (81) receives no drive permission signal (SE), even if the heat exchange in the utilization heat exchanger (70) is required. More specifically, when the receiving section (81) receives no drive permission signal (SE), the valve controller (82) fully closes the utilization expansion valve (71) regardless of whether the heat exchange in the utilization heat exchanger (70) is required.

In this example, the valve controller (82) opens the utilization expansion valve (71) when the heat exchange in the utilization heat exchanger (70) is required, on condition that the relay (81*a*) be closed. Specifically, the valve controller (82) opens the utilization expansion valve (71) when the relay (81*a*) is closed and the heat exchange in the utilization heat exchanger (70) is required. The valve controller (82) adjusts the opening degree of the utilization expansion valve (71) as necessary. The valve controller (82) fully closes the utilization expansion valve (71) when the relay (81*a*) is closed and the heat exchange in the utilization heat exchanger (70) is no longer necessary. The valve controller (82) does not open the utilization expansion valve (71) when the relay (81*a*) is open, even if the heat exchange in the utilization heat exchanger (70) is required. Specifically, when the relay (81*a*) is open, the valve controller (82) fully closes the utilization expansion valve (71) regardless of whether the heat exchange in the utilization heat exchanger (70) is required. In other words, in this example, when the relay (81*a*) is open, the valve controller (82) cannot transmit an instruction to open the utilization expansion valve (71) to the utilization expansion valve (71) regardless of whether the heat exchange in the utilization heat exchanger (70) is required.

In this example, the valve controller (82) is activated when the relay (81*a*) is closed and the power source voltage (VS) is supplied to the valve controller (82). The valve controller (82) opens the utilization expansion valve (71) in response to a request for the heat exchange in the utilization heat exchanger (70), and adjusts the opening degree of the utilization expansion valve (71) as necessary. When the relay (81*a*) is open and the power source voltage (VS) is no longer supplied to the valve controller (82), the valve controller (82) stops. The utilization expansion valve (71) is configured to be fully closed while the valve controller (82) is stopped.

[Operation of Utilization Controller while Utilization Expansion Valve is Fully Closed]

Figure 8:
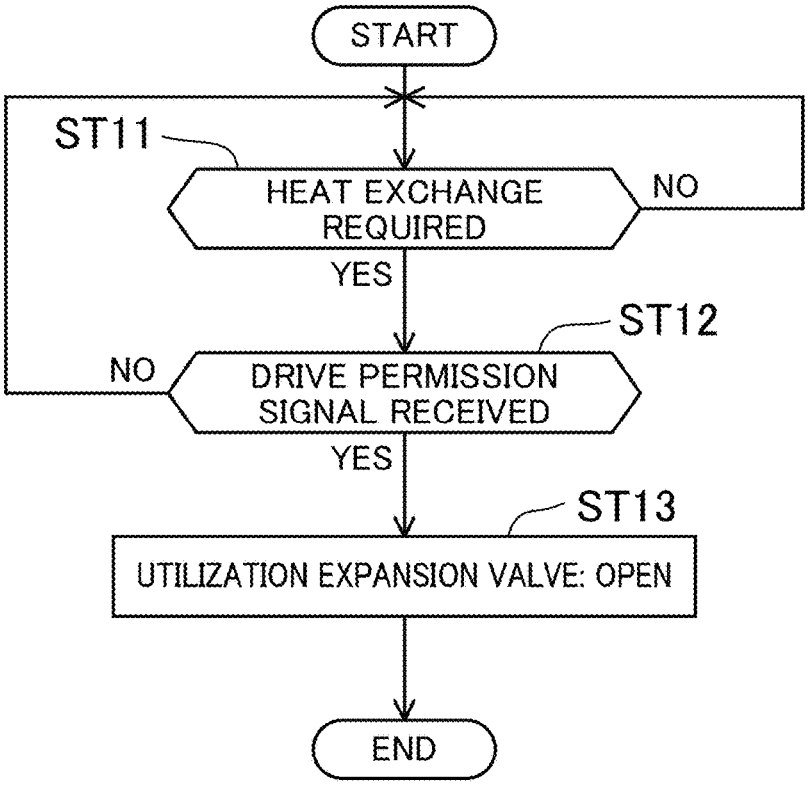

How the utilization controller (18) operates when the utilization expansion valve (71) is fully closed will be described with reference to FIG. 8.

<Step (ST11)>

The utilization controller (18) (i.e., the main controller (80)) determines whether the heat exchange in the utilization heat exchanger (70) is required. In this example, when the heat exchange in the utilization heat exchanger (70) is required, the main controller (80) transmits an instruction signal for opening the utilization expansion valve (71) to the valve controller (82). Then, the processing of Step (ST12) is performed.

<Step (ST12)>

Next, the processing of Step (ST13) or Step (ST11) is performed in accordance with whether the utilization controller (18) has received the drive permission signal (SE). Specifically, when the receiving section (81) has received the drive permission signal (SE), the processing of Step (ST13) is performed. Otherwise, the processing of Step (ST11) is performed.

In this example, the relay (81*a*) is energized and closed when the receiving section (81) has received the drive permission signal (SE). As a result, the power source voltage (VS) is supplied to the valve controller (82), and the valve controller (82) operates. Then, the processing of Step (ST13) is performed. When the receiving section (81) receives no drive permission signal (SE), the relay (81*a*) is deenergized and opened. As a result, no power source voltage (VS) is supplied to the valve controller (82), and the valve controller (82) stops. Then, the processing of Step (ST11) is performed.

<Step (ST13)>

When the heat exchange in the utilization heat exchanger (70) is required and the utilization controller (18) has received the drive permission signal (SE), the utilization controller (18) opens the utilization expansion valve (71). Specifically, when the receiving section (81) has received the drive permission signal (SE), the valve controller (82) opens the utilization expansion valve (71) upon receiving an instruction signal (instruction signal for opening the utilization expansion valve (71)) transmitted from the main controller (80).

[Operation of Heat Source Controller During Stop of Compression Element]

Figure 9:
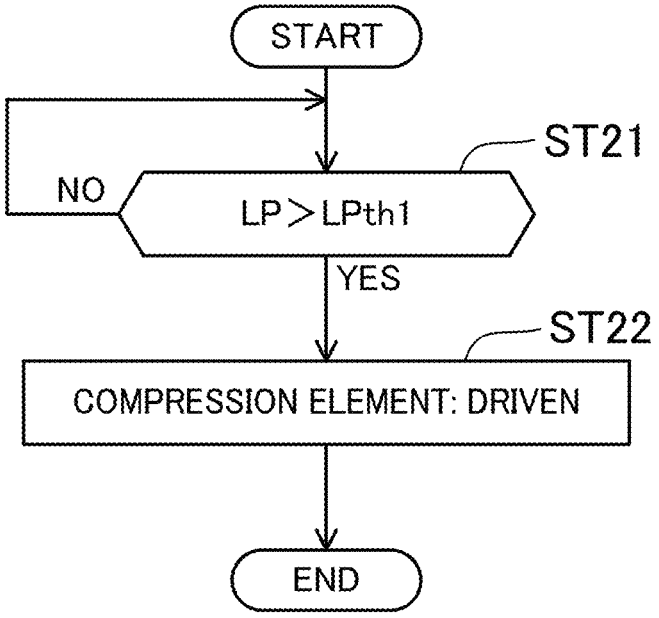
FIG. 9 is a flowchart illustrating operation of the heat source controller while a compression element is stopped.

Next, operation of the heat source controller (14) during the stop of the compression element (20) will be described with reference to FIG. 9.

<Step (ST21)>

The heat source controller (14) determines whether the suction pressure (LP) of the compression element (20) exceeds the first pressure (LPth1). For example, the suction pressure (LP) of the compression element (20) is detected by the first suction pressure sensor (S21) and the second suction pressure sensor (S22). The heat source controller (14) may determine the lower one of the pressures detected by the first suction pressure sensor (S21) and the second suction pressure sensor (S22) as the suction pressure (LP) of the compression element (20), and determine whether the suction pressure (LP) of the compression element (20) exceeds the first pressure (LPth1). The processing of Step (S121) is repeated until the suction pressure (LP) of the compression element (20) exceeds the first pressure (LPth1), and the processing of Step (ST22) is performed when the suction pressure (LP) of the compression element (20) exceeds the first pressure (LPth1).

<Step (ST22)>

The heat source controller (14) drives the compression element (20) being stopped.

[Operation of Heat Source Controller while Compression Element is Driven]

Figure 10:
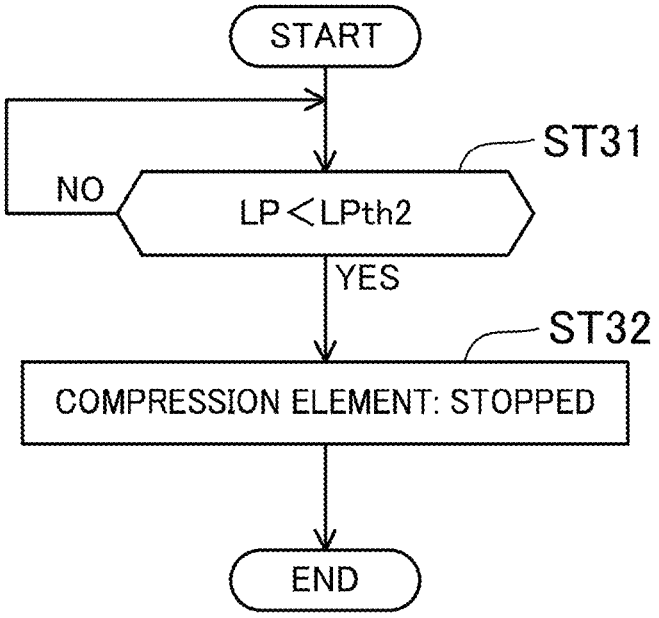
FIG. 10 is a flowchart illustrating operation of the heat source controller while the compression element is driven.

Next, operation of the heat source controller (14) while the compression element (20) is driven will be described with reference to FIG. 10.

<Step (ST31)>

The heat source controller (14) determines whether the suction pressure (LP) of the compression element (20) falls below the second pressure (LPth2). The processing of Step (ST21) is repeated until the suction pressure (LP) of the compression element (20) falls below the second pressure (LPth2), and the processing of Step (ST22) is performed when the suction pressure (LP) of the compression element (20) falls below the second pressure (LPth2).

<Step (ST32)>

The heat source controller (14) stops the compression element (20) being driven.

Feature (1) of Embodiment

As described above, the refrigeration apparatus (1) of the present embodiment is a refrigeration apparatus (1) using carbon dioxide as a refrigerant. The refrigeration apparatus (1) includes: the heat source unit (10) having the compression element (20), the heat source heat exchanger (40), and the heat source controller (14); and the utilization unit (15) having the utilization heat exchanger (70), the utilization expansion valve (71), and the utilization controller (18). The heat source unit (10) and the utilization unit (15) are connected. The heat source controller (14) transmits the drive permission signal (SE) to the utilization controller (18) when the compression element (20) is drivable. The valve controller (82) of the utilization controller (18) opens the utilization expansion valve (71) when the heat exchange in the utilization heat exchanger (70) is required, on condition that the receiving section (81) of the utilization controller (18) receive the drive permission signal (SE).

In the present embodiment, the heat source controller (14) transmits the drive permission signal (SE) when the compression element (20) is drivable. The heat source controller (14) does not transmit the drive permission signal (SE) when the compression element (20) is undrivable. The valve controller (82) of the utilization controller (18) opens the utilization expansion valve (71) when the receiving section (81) of the utilization controller (18) has received the drive permission signal (SE) and the heat exchange in the utilization heat exchanger (70) is required. The valve controller (82) of the utilization controller (18) does not open the utilization expansion valve (71) when the receiving section (81) of the utilization controller (18) receives no drive permission signal (SE), even if the heat exchange in the utilization heat exchanger (70) is required. This configuration can avoid a situation in which the utilization expansion valve (71) of the utilization unit (15) opens when the compression element (20) of the heat source unit (10) is undrivable.

The utilization expansion valve (71) of the utilization unit (15) cart be avoided from opening when the compression element (20) of the heat source unit (10) is undrivable. The abnormal increase in the pressure of the low-pressure refrigerant in the refrigerant circuit (100) (specifically, the pressure of the refrigerant on the suction side of the compression element (20)) can thus be avoided. This can avoid unwanted operation of a pressure release valve (e.g., the pressure release valve (RV)) provided in the refrigerant circuit (100).

The refrigeration apparatus of Patent Document 1 (Japanese Unexamined Patent Publication No. 2015-49021) is configured to operate a safety valve, thereby leaking the refrigerant to the outside, when the pressure of the low-pressure refrigerant in the refrigerant circuit increases to 7.8 MPa. However, the refrigeration apparatus of Patent Document 1 takes no measures to avoid unwanted operation of the safety valve (e.g., a pressure release valve (RV)).

Feature (2) of Embodiment

In the refrigeration apparatus (1) of this embodiment, the utilization controller (18) includes the receiving section (81) configured to receive the drive permission signal (SE). The valve controller (82) of the utilization controller (18) opens the utilization expansion valve (71) when the heat exchange in the utilization heat exchanger (70) is required, on condition that the receiving section (81) receive the drive permission signal (SE).

In the present embodiment, the valve controller (82) of the utilization controller (18) opens the utilization expansion valve (71) when the receiving section (81) has received the drive permission signal (SE) and the heat exchange in the utilization heat exchanger (70) is required. The valve controller (82) of the utilization controller (18) does not open the utilization expansion valve (71) when the receiving section (81) receives no drive permission signal (SE), even if the heat exchange in the utilization heat exchanger (70) is required. This configuration can avoid a situation in which the utilization expansion valve (71) of the utilization unit (15) opens when the compression element (20) of the heat source unit (10) is undrivable.

Feature (3) of Embodiment

In the refrigeration apparatus (1) of this embodiment, the receiving section (81) of the utilization controller (18) includes the relay (81*a*) configured to be closed when energized and opened when deenergized. The relay (81*a*) is energized and closed when the receiving section (81) receives the drive permission signal (SE), The valve controller (82) of the utilization controller (18) opens the utilization expansion valve (71) when the heat exchange in the utilization heat exchanger (70) is required, on condition that the relay (81*a*) be closed.

In the present embodiment, the valve controller (82) of the utilization controller (18) opens the utilization expansion valve (71) when the relay (81*a*) is closed and the heat exchange in the utilization heat exchanger (70) is required. The valve controller (82) of the utilization controller (18) does not open the utilization expansion valve (71) when the relay (81*a*) is open, even if the heat exchange in the utilization heat exchanger (70) is required. This configuration can avoid a situation in which the utilization expansion valve (71) of the utilization unit (15) opens when the compression element (20) of the heat source unit (10) is undrivable.

When a power failure occurs in the heat source unit (10), the compression element (20) and the heat source controller (14) provided in the heat source unit (10) stop. When the heat source controller (14) stops, the transmission of the drive permission signal (SE) stops. In the utilization unit (15), the relay (81*a*) of the receiving section (81) is deenergized and opened when the transmission of the drive permission signal (SE) stops. As a result, the valve controller (82) does not open the utilization expansion valve (71), even if the heat exchange in the utilization heat exchanger (70) is required. Thus, the relay (81*a*) can be automatically opened when a power failure occurs in the heat source unit (10). This can avoid the utilization expansion valve (71) of the utilization unit (15) from opening when a power failure occurs in the heat source unit (10).

Feature (4) of Embodiment

In the refrigeration apparatus (1) of this embodiment, the heat source controller (14) drives the compression element (20) when the compression element (20) is in the stopped state and the pressure (LP) of the refrigerant on the suction side of the compression element (20) exceeds the predetermined first pressure (LPth1).

In the present embodiment, the pressure (LP) of the refrigerant on the suction side of the compression element (20) gradually increases when the compression element (20) of the heat source unit (10) is in the stopped state and the utilization expansion valve (71) is opened due to need for the heat exchange in the utilization heat exchanger (70) of the utilization unit (15). Thus, the compression element (20) is driven when the pressure (LP) of the refrigerant on the suction side of the compression element (20) exceeds the first pressure (LPth1). This can drive the compression element (20) of the heat source unit (10) when the heat exchange in the utilization heat exchanger (70) of the utilization unit (15) is required, thereby allowing normal heat exchange in the utilization heat exchanger (70).

Feature (5) of Embodiment

In the refrigeration apparatus (1) of this embodiment, the heat source controller (14) does not transmit the drive permission signal (SE) when the heat source unit (10) is unable to operate normally.

In the present embodiment, the compression element (20) cannot be driven when the heat source unit (10) cannot operate normally. It is thus possible to avoid a situation in which the utilization expansion valve (71) of the utilization unit (15) is open when the heat source unit (10) cannot operate normally, by transmitting no drive permission signal (SE).

Feature (6) of Embodiment

The heat source unit (10) of this embodiment is a heat source unit that forms, together with the utilization unit (15), a refrigeration apparatus (1) using carbon dioxide as a refrigerant. The utilization unit (15) has the utilization heat exchanger (70), the utilization expansion valve (71), and the valve controller (82) of the utilization controller (18) configured to open the utilization expansion valve (71) when the heat exchange in the utilization heat exchanger (70) is required, on condition that the utilization controller (18) receive the drive permission signal (SF). The heat source unit includes: the compression element (20), the heat source heat exchanger (40), and the heat source controller (14). The heat source controller (14) transmits the drive permission signal (SE) to the receiving section (81) of the utilization controller (18) when the compression element (20) is drivable.

In the present embodiment, the heat source controller (14) transmits the drive permission signal (SE) when the compression element (20) is drivable. The heat source controller (14) does not transmit the drive permission signal (SE) when the compression element (20) is undrivable. The valve controller (82) of the utilization controller (18) opens the utilization expansion valve (71) when the receiving section (81) of the utilization controller (18) has received the drive permission signal (SE) and the heat exchange in the utilization heat exchanger (70) is required. The valve controller (82) of the utilization controller (18) does not open the utilization expansion valve (71) when the receiving section (81) of the utilization controller (18) receives no drive permission signal (SE), even if the heat exchange in the utilization heat exchanger (70) is required. This configuration can avoid a situation in which the utilization expansion valve (71) of the utilization unit (15) opens when the compression element (20) of the heat source unit (10) is undrivable.

Other Embodiments

The compression element (20) described above may have two or fewer compressors, or four or more compressors. The compression element (20) may include a plurality of compressors, or may be configured as a multiple stage compression mechanism provided in a single casing.

It has been described that the refrigeration apparatus (1) includes the utilization unit (15) constituting the indoor unit (15*a*) and the utilization unit (15) constituting the cold storage unit (15*b*). However, the refrigeration apparatus (1) is not limited to include these utilization units. For example, the refrigeration apparatus (1) may include a utilization unit (15) constituting a heating unit for heating the inside of a warm storage.

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

INDUSTRIAL APPLICABILITY

As can be seen in the foregoing, the present disclosure is useful for a refrigeration apparatus and a heat source unit.

EXPLANATION OF REFERENCES

1 Refrigeration Apparatus
10 Heat Source Unit
11 Heat Source Circuit
12 Heat Source Fan
13 Cooling Fan
14 Heat Source Controller
15 Utilization Unit
16 Utilization Circuit
17 Utilization Fan
18 Utilization Controller
20 Compression Element
30 Switching Unit
40 Heat Source Heat Exchanger
41 Receiver
42 Cooling Heat Exchanger
43 Intercooler
44 Heat Source Expansion Valve
45 Cooling Expansion Valve
46 Venting Valve
70 Utilization Heat Exchanger
71 Utilization Expansion Valve
80 Main Controller
81 Receiving Section
81*a* Relay
82 Valve Controller
100 Refrigerant Circuit
SE Drive Permission Signal

The invention claimed is:

1. A refrigeration apparatus using carbon dioxide as a refrigerant, the refrigeration apparatus comprising:
- a heat source unit having a compressor assembly, a heat source heat exchanger, and a heat source controller; and
- a utilization unit having a utilization heat exchanger, a utilization expansion valve, and a utilization controller, wherein
- the heat source unit and the utilization unit are connected,
- the heat source controller transmits a drive permission signal (SE) to the utilization controller when the compressor assembly is drivable, and does not transmit the drive permission signal (SE) to the utilization controller when the compressor assembly is not drivable, and
- the utilization controller
  - includes a relay configured to be closed when the drive permission signal (SE) is supplied and the relay is energized, and opened when supply of the drive permission signal (SE) is stopped and the relay is deenergized, and
  - opens the utilization expansion valve when heat exchange in the utilization heat exchanger is required, on condition that the relay is closed.

2. The refrigeration apparatus of claim 1, wherein
- in an initial operation in which the compressor assembly is in a stopped state, the heat source controller subsequently drives the compressor assembly when a pressure (LP) of a refrigerant on a suction side of the compressor assembly exceeds a predetermined first pressure (LPth1).

3. The refrigeration apparatus of claim 1, wherein
- the heat source controller does not transmit the drive permission signal (SE) when the heat source unit is unable to operate normally.

4. A heat source unit that forms, together with a utilization unit, a refrigeration apparatus using carbon dioxide as a refrigerant, the utilization unit having a utilization heat exchanger, a utilization expansion valve, and a utilization controller, the utilization controller including a relay configured to be closed when a drive permission signal (SE) is supplied and the relay is energized, and opened when supply of the drive permission signal (SE) is stopped and the relay is deenergized, the utilization controller configured to open the utilization expansion valve when heat exchange in the utilization heat exchanger is required, on condition that the relay is closed, the heat source unit comprising:
- a compressor assembly; a heat source heat exchanger; and a heat source controller, wherein
- the heat source controller transmits the drive permission signal (SE) to the relay of the utilization controller when the compressor assembly is drivable, and does not transmit the drive permission signal (SE) to the relay of the utilization controller when the compressor assembly is not drivable, and
- the heat source unit enables the utilization controller to open the utilization expansion valve when the heat exchange in the utilization heat exchanger is required, on condition that the relay is closed.

5. The heat source unit of claim 4, wherein
- in an initial operation in which the compressor assembly is in a stopped state, the heat source controller subsequently drives the compressor assembly when a pressure (LP) of a refrigerant on a suction side of the compressor assembly exceeds a predetermined first pressure (LPth1).

6. The refrigeration apparatus of claim 5, wherein the heat source controller does not transmit the drive permission signal (SE) when the heat source unit is unable to operate normally.

7. The heat source unit of claim 4, wherein the heat source controller does not transmit the drive permission signal (SE) when the heat source unit is unable to operate normally.

8. The refrigeration apparatus of claim 2, wherein the heat source controller does not transmit the drive permission signal (SE) when the heat source unit is unable to operate normally.

* * * * *